US010981703B1

(12) United States Patent
Fang

(10) Patent No.: US 10,981,703 B1
(45) Date of Patent: Apr. 20, 2021

(54) COVER STRUCTURE OF CUP (BOTTLE)

(71) Applicant: Tsuan-Yi Fang, Taichung (TW)

(72) Inventor: Tsuan-Yi Fang, Taichung (TW)

( * ) Notice: Subject to any disclaimer, the term of this patent is extended or adjusted under 35 U.S.C. 154(b) by 0 days.

(21) Appl. No.: 16/785,149

(22) Filed: Feb. 7, 2020

(51) Int. Cl.
*B65D 47/20* (2006.01)
*B65D 43/02* (2006.01)
*B65D 51/24* (2006.01)

(52) U.S. Cl.
CPC ..... *B65D 47/20* (2013.01); *B65D 43/0231* (2013.01); *B65D 51/24* (2013.01)

(58) Field of Classification Search
CPC .... B65D 47/20; B65D 43/0231; B65D 51/24; B65D 47/04; A47G 19/22
USPC ..... 222/111, 182, 481
See application file for complete search history.

(56) References Cited

U.S. PATENT DOCUMENTS 4,852,762 A * 8/1989 Chou-Sheng ..... A45F 3/16 220/709
5,150,815 A * 9/1992 Saklad ..... A47G 19/2227 215/12.1
5,337,918 A * 8/1994 Wang ..... A47G 19/2266 215/229
5,497,901 A * 3/1996 Chen ..... A47G 19/2266 215/388
6,390,341 B1 * 5/2002 Ohmi ..... B65D 47/0809 222/182
2019/0152679 A1 * 5/2019 Park ..... B65D 83/00

* cited by examiner

*Primary Examiner* — Vishal Pancholi
(74) *Attorney, Agent, or Firm* — Sinorica, LLC

(57) ABSTRACT

A cover structure of a cup (bottle) is disclosed. The cup (bottle) has an accommodating space therein for containing a liquid. An upper end of the cup (bottle) has an opening. The cover structure includes a cover body and a liquid discharge mechanism. The cover body has a first plane for closing the opening, a wall portion extending upward from the first plane by a predetermined height, and a second plane extending horizontally from an upper edge of the wall portion and parallel to the first plane. The liquid discharge mechanism includes a guide tube insertedly disposed on the first plane for guiding the liquid in the cup (bottle) and a switch disposed on the guide tube. The guide tube has an outlet end extending out of the wall portion. When the cup (bottle) is inverted, the liquid in the cup (bottle) is discharged through the guide tube for drinking.

5 Claims, 8 Drawing Sheets

COVER STRUCTURE OF CUP (BOTTLE)

FIELD OF THE INVENTION

The present invention relates to a cover structure, and more particularly to a cover structure of a cup (bottle) that enables a liquid contained in a large cup to flow to a small cup for drinking conveniently.

BACKGROUND OF THE INVENTION

A drink is generally contained in a container, such as a cup or bottle for drinking. In order to avoid spilling the drink and for safety and hygiene, the opening at the upper end of the container is closed with a cover. When the user wants to drink the drink, the cover can be opened for drinking the drink in the cup (bottle). Alternatively, the cover is formed with an aperture for the user to drinking the drink in the cup (bottle) through the aperture of the cover. However, no matter how the user drinks the drink through the opening of the cup (bottle) or the aperture of the cover, the drink may spill or burn the user's mouth. In addition, some premium drinks such as coffee, wine, tea, etc., are made of high-quality materials by special methods, which have excellent taste, smell, and mouthfeel. It is suitable for the user to sip the drinks with a small cup. If the user drinks the drink by taking big mouthfuls, he/she cannot feel the flavors of the drinks and lacks the elegant temperament for drinking high-end drinks. Accordingly, the inventor of the present invention has devoted himself based on his many years of practical experiences to solve these problems.

SUMMARY OF THE INVENTION

The primary object of the present invention is to provide a cover structure of a cup (bottle). The cover structure comprises a cover body and a liquid discharge mechanism. The liquid discharge mechanism includes a guide tube extending out of the cover body and a switch for controlling a liquid contained in the cup (bottle) to be discharged. When the cup (bottle) is in an inverted state, the liquid can be output to another cup through the guide tube for drinking, thereby achieving a safe, convenient and high-quality drinking effect.

Another object of the present invention is to provide a cover structure of a cup (bottle), wherein the cover body is provided with an accommodating room for accommodating a small cup, thereby achieving the effect of convenient use.

In order to achieve the aforesaid object, the present invention provides a cover structure of a cup (bottle). An inside of the cup (bottle) is concavely formed with an accommodating space for containing a predetermined liquid. An upper end of the cup (bottle) is formed with an opening communicating with the accommodating space. The cover structure comprises a cover body and a liquid discharge mechanism. The cover body has a first plane for closing the opening of the cup (bottle), a wall portion extending upward from the first plane by a predetermined height, and a second plane extending horizontally from an upper edge of the wall portion and parallel to the first plane. The liquid discharge mechanism includes a guide tube insertedly disposed on the first plane for guiding the liquid in the cup (bottle) and a switch disposed on the guide tube for controlling the liquid to be discharged. One end of the guide tube is defined as an inlet end extending into the accommodating space of the cup (bottle). Another opposing end of the guide tube is defined as an outlet end extending out of the cover body and having a predetermined height from the second plane.

Preferably, an inside of the cover body is concavely formed with an accommodating room. One side of the wall portion is formed with an exit communicating with the accommodating room.

Preferably, a small cup is provided in the accommodating room, and the small cup can be taken out via the exit.

Preferably, an outer periphery of the outlet end of the guide tube is formed with a hole. The switch is sleeved on the outlet end of the guide tube. An outer periphery of the switch is formed with an outlet. The switch is rotatable to align the outlet with the hole of the guide tube.

Preferably, an outer periphery of the switch is provided with a handle portion.

Preferably, the cover structure further comprises a tube that is insertedly disposed below the first plane of the cover body. A lower end of the tube extends into the accommodating space of the cup (bottle).

Preferably, the switch includes a push plate extending out of the cover body, a block plate extending to the inlet end of the guide tube, and a pivot pin that couples the push plate and the block plate to the first plane.

Embodiments of the present invention will now be described, by way of example only, with reference to the accompanying drawings.

DETAILED DESCRIPTION OF THE PREFERRED EMBODIMENTS

Figure 1:
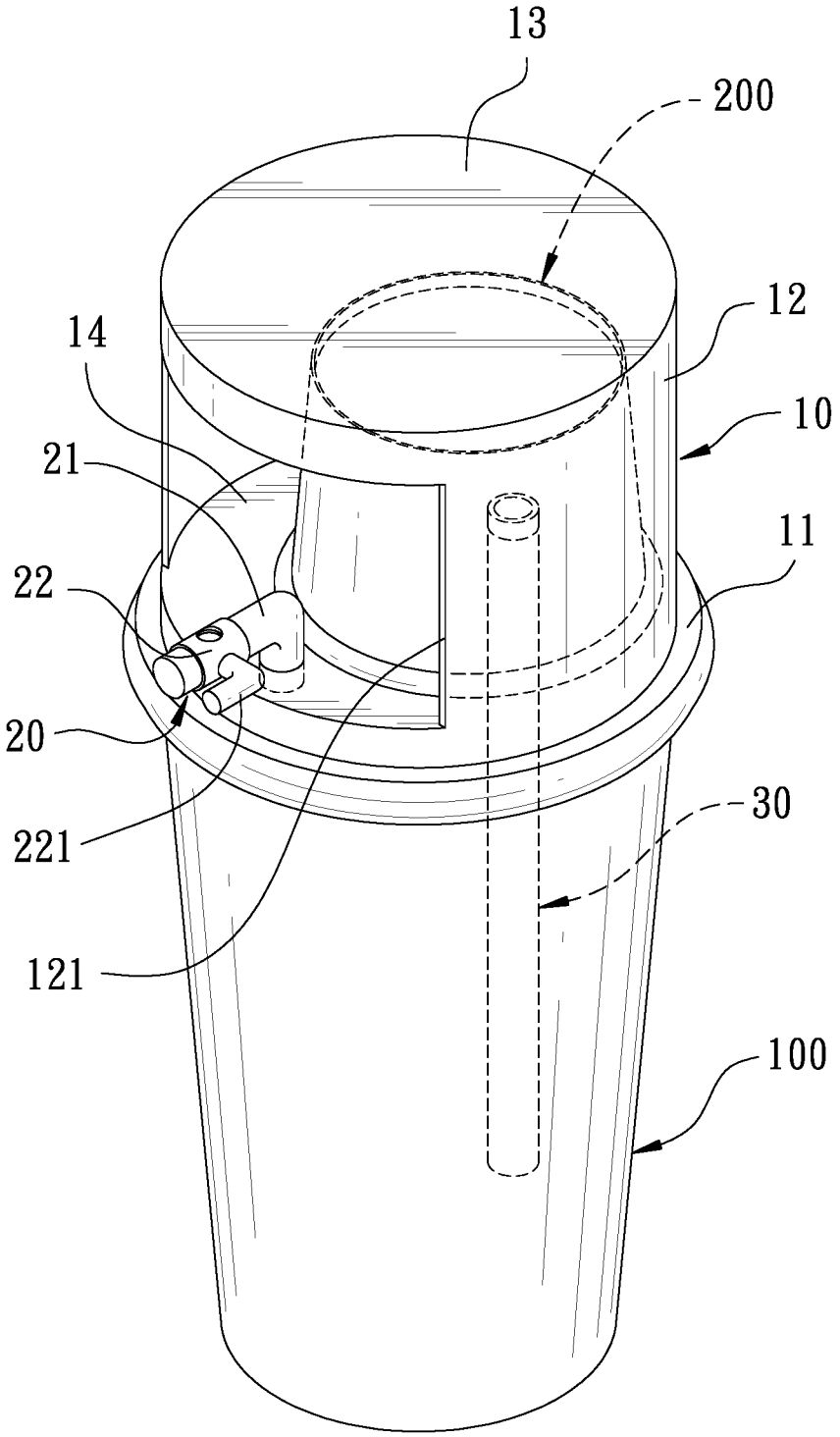
FIG. 1 is a perspective view in accordance with a first embodiment of the present invention, illustrating the assembly of the cover structure of the present invention and a cup.
Figure 2:
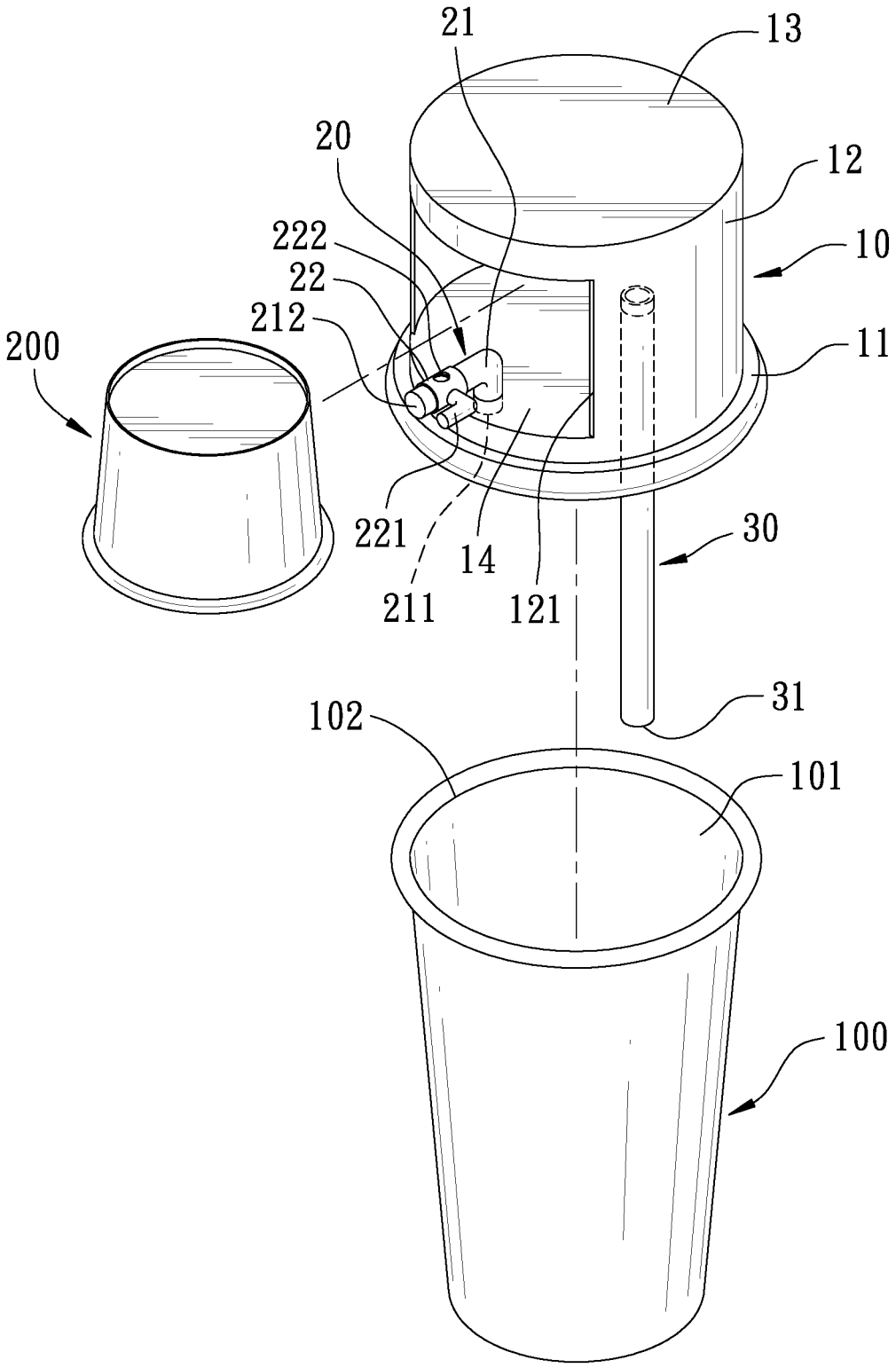
FIG. 2 is an exploded view in accordance with the first embodiment of the present invention, illustrating that the cover structure of the present invention comprises a cover body and a liquid discharge mechanism.
Figure 3:
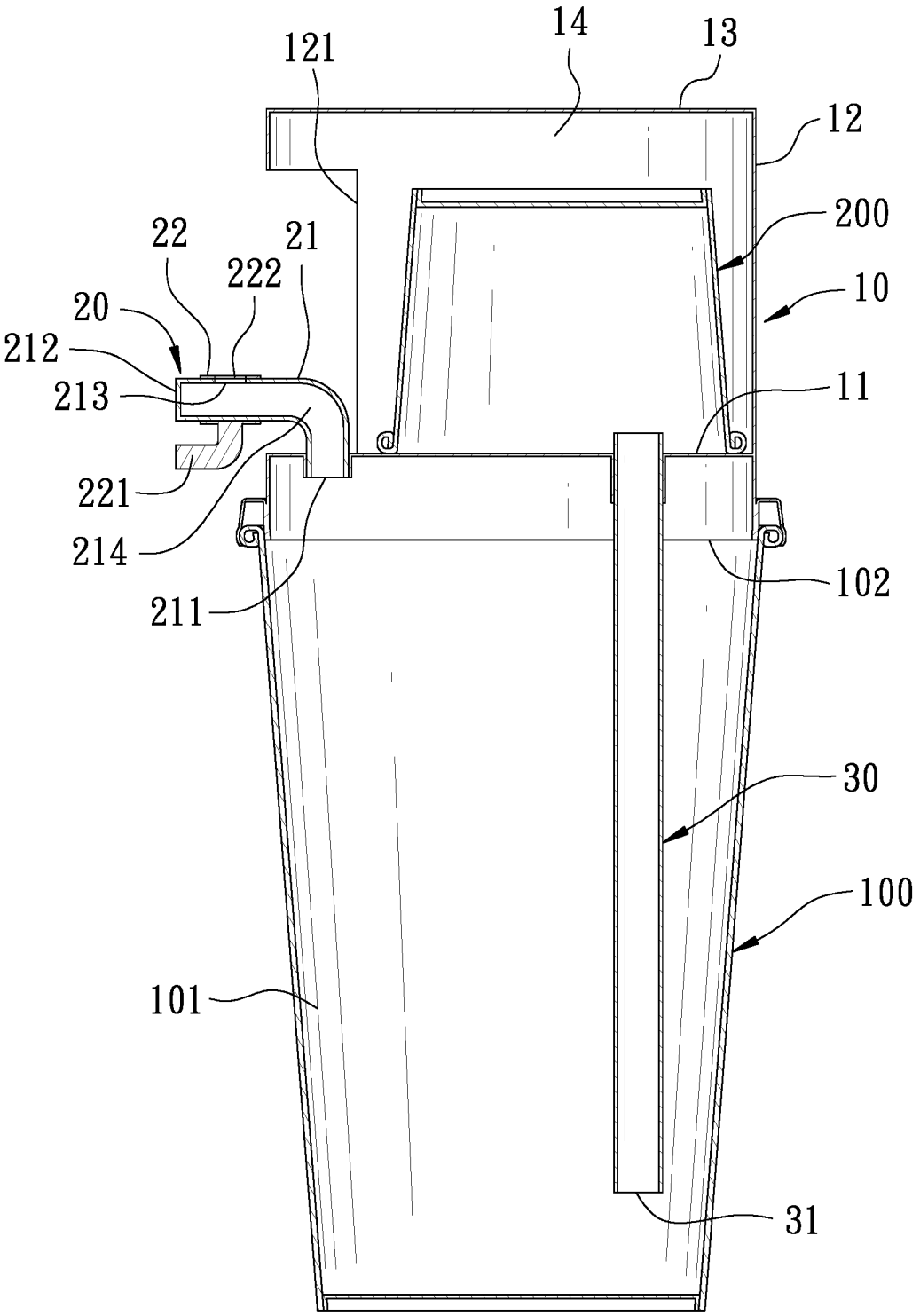
FIG. 3 is a cross-sectional view in accordance with the first embodiment of the present invention, illustrating that the liquid discharge mechanism comprises a guide tube and a switch.

FIGS. 1-3 illustrate a cover structure of a cup (bottle) according to a first embodiment of the present invention.

The container for containing a liquid is a cup 100. The inside of the cup 100 is concavely formed with an accommodating space 101 for containing a liquid. The upper end of the cup 100 is formed with an opening 102 communicating with the accommodating space 101. The cover structure of the present invention mainly includes a cover body 10, a liquid discharge mechanism 20, and a tube 30.

The cover body 10 has a first plane 11 for closing the opening 102 of the cup 100, a wall portion 12 extending upward from the first plane 11 by a predetermined height, and a second plane 13 extending horizontally from the upper edge of the wall portion 12 and parallel to the first plane 11. The inside of the cover body 10 is concavely formed with an accommodating room 14. The accommodating room 14 is configured to place a small cup 200 therein. One side of the wall portion 12 is formed with an exit 121 communicating with the accommodating room 14. The small cup 200 can be put into the accommodating room 14 or taken out via the exit 121.

Figure 4:
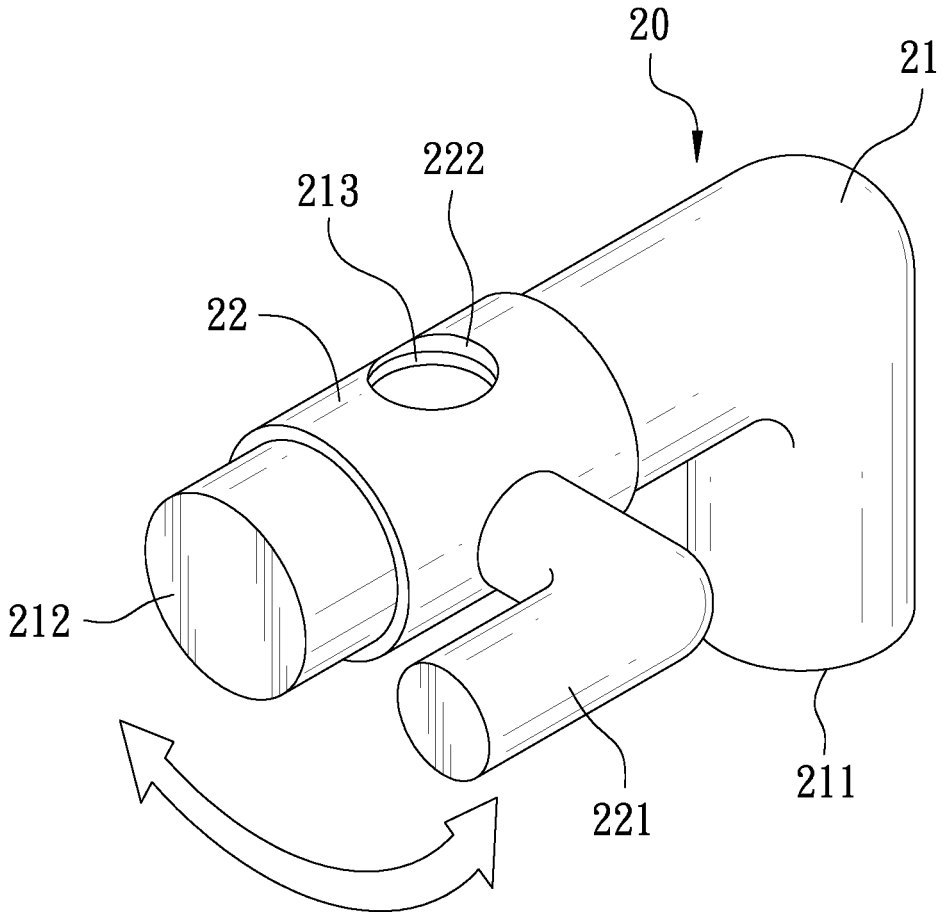
FIG. 4 is an enlarged view in accordance with the first embodiment of the present invention, illustrating that the switch controls the guide tube to discharge a liquid in a rotating manner.

The liquid discharge mechanism 20 includes a guide tube 21 insertedly disposed above the first plane 11 for guiding the liquid in the cup 100 and a switch 22 disposed on the guide tube 21 for controlling the liquid to be discharged. The guide tube 21 is a reverse L-shaped tube. An end of the guide tube 21 is defined as an inlet end 211 extending into the accommodating space 101 of the cup 100, and another opposing end of the guide tube 21 is defined as an outlet end 212 extending out of the cover body 10 and having a predetermined height from the second plane 13. The reason for the outlet end 212 to have the predetermined height from the second plane 13 is that there is a space for the small cup 200 to be placed when the cup 100 is inverted. Referring to FIG. 3 and FIG. 4, the outlet end 212 of the guide tube 21 is a closed end, but a hole 213 is formed on the outer periphery of the outlet end 212. The switch 22 is an annular sleeve that is sleeved on the outlet end 212 of the guide tube 21 and is rotatable. A handle portion 221 is integrally formed with the outer periphery of the switch 22 for a user's hand to hold thereon and rotate the switch 22. The outer periphery of the switch 22 is formed with an outlet 222 corresponding in position to the hole 213 of the guide tube 21.

The tube 30 is insertedly disposed below the first plane 11 of the cover body 10. A lower end 31 of the tube 30 extends into the accommodating space 101 of the cup 100. The inner pressure of the cup 100 is balanced with the external atmospheric pressure through the tube 30, so that the liquid in the cup 100 can be smoothly discharged.

The above is an overview of the main components and the assembly of the cover structure of the cup (bottle) of the present invention. Next, the use and operation and expected effects of the present invention are described below.

Figure 5:
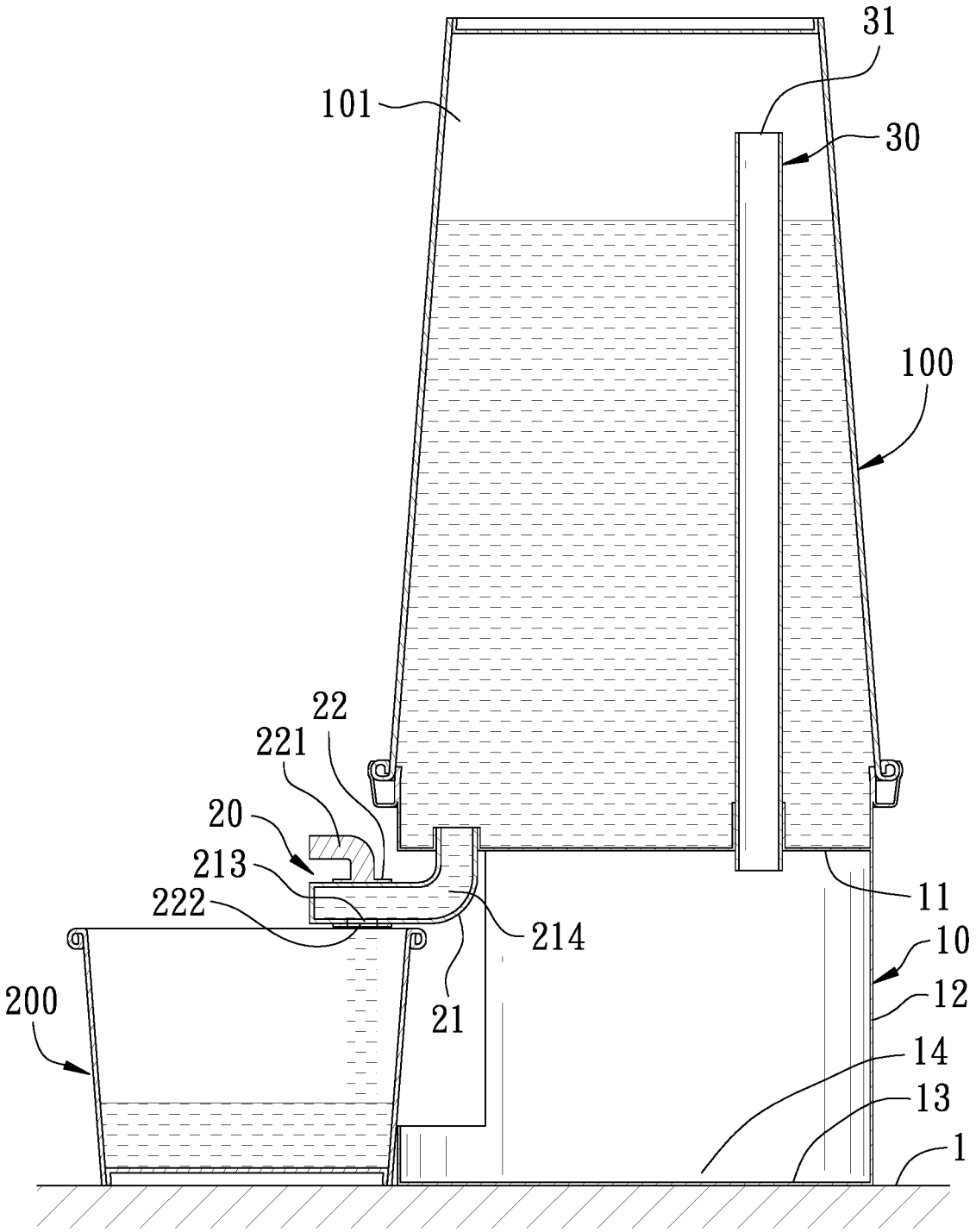
FIG. 5 is a schematic view of the operation of the first embodiment of the present invention, illustrating that the liquid contained in the cup can be poured into a small cup via the guide tube when the cup is in an inverted state.

Referring to FIG. 5, when the user wants to drink the liquid in the cup 100, the cup 100 is inverted, and the second plane 13 of the cover body 10 is placed on a tabletop 1. The small cup 200 is taken out from the cover body 10 and placed on the tabletop 1, so that the guide tube 21 is just above the small cup 200. At this time, the user rotates the switch 22 for the outlet 222 of the switch 22 to be aligned with the hole 213 of the guide tube 21. In this way, the liquid in the cup 100 can flow to the outlet 222 through the guide tube 21 to be poured into the small cup 200, so that the user can conveniently taste the liquid with the small cup 200.

Figure 6:
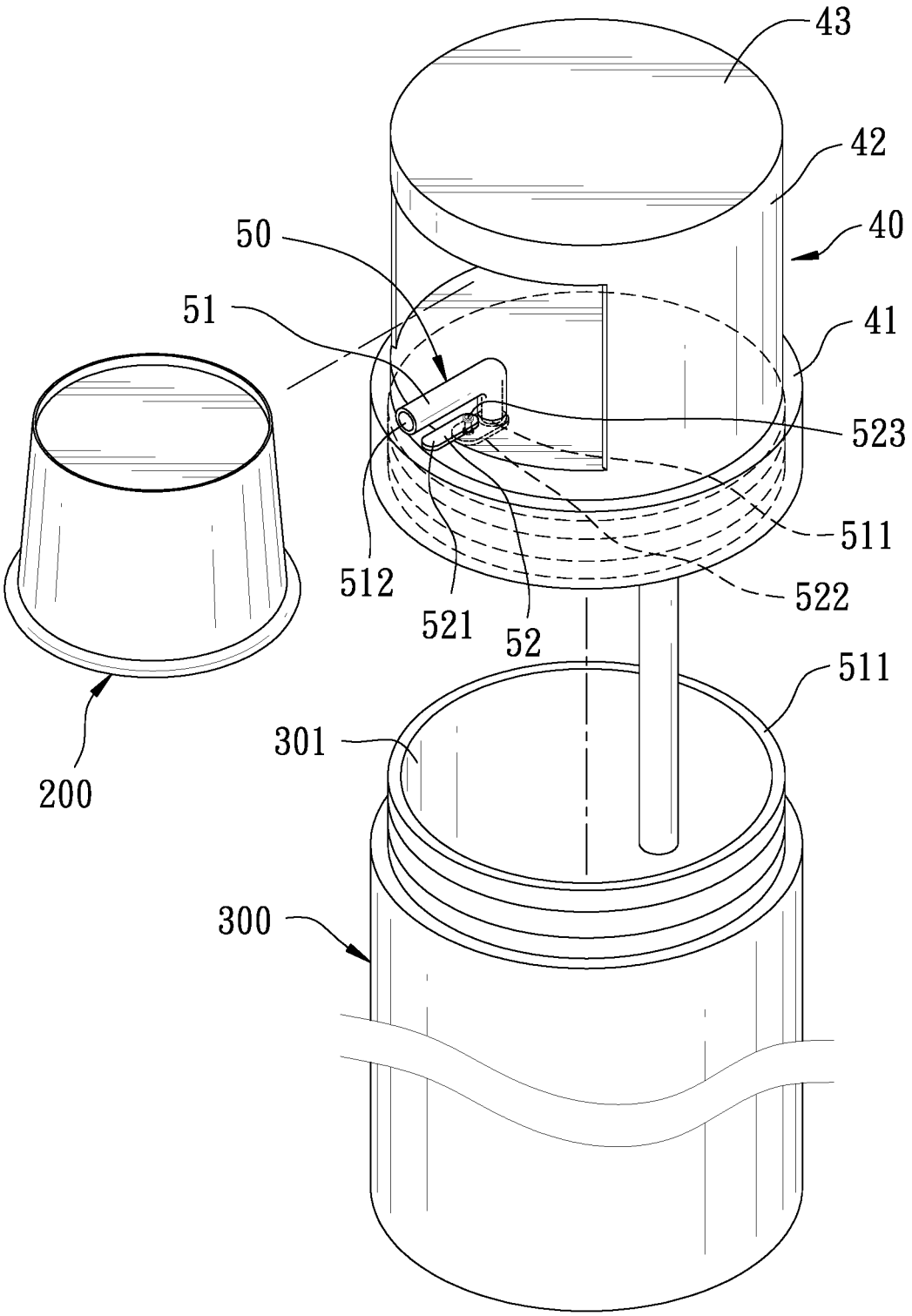
FIG. 6 is an exploded view in accordance with a second embodiment of the present invention, illustrating that another cup body of the present invention is combined with a bottle, and another liquid discharge mechanism includes a guide tube and a switch.
Figure 7:
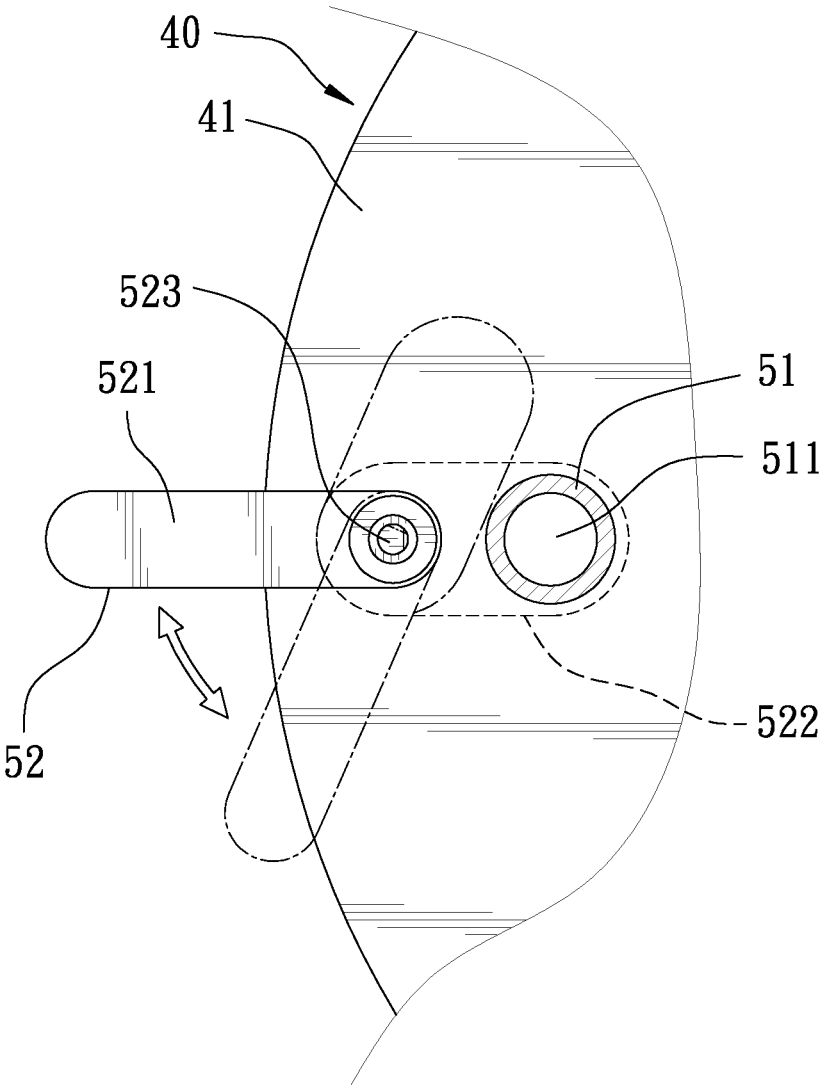
FIG. 7 is an enlarged view in accordance with the second embodiment of the present invention, illustrating that the switch controls the guide tube to discharge a liquid in a push manner.
Figure 8:
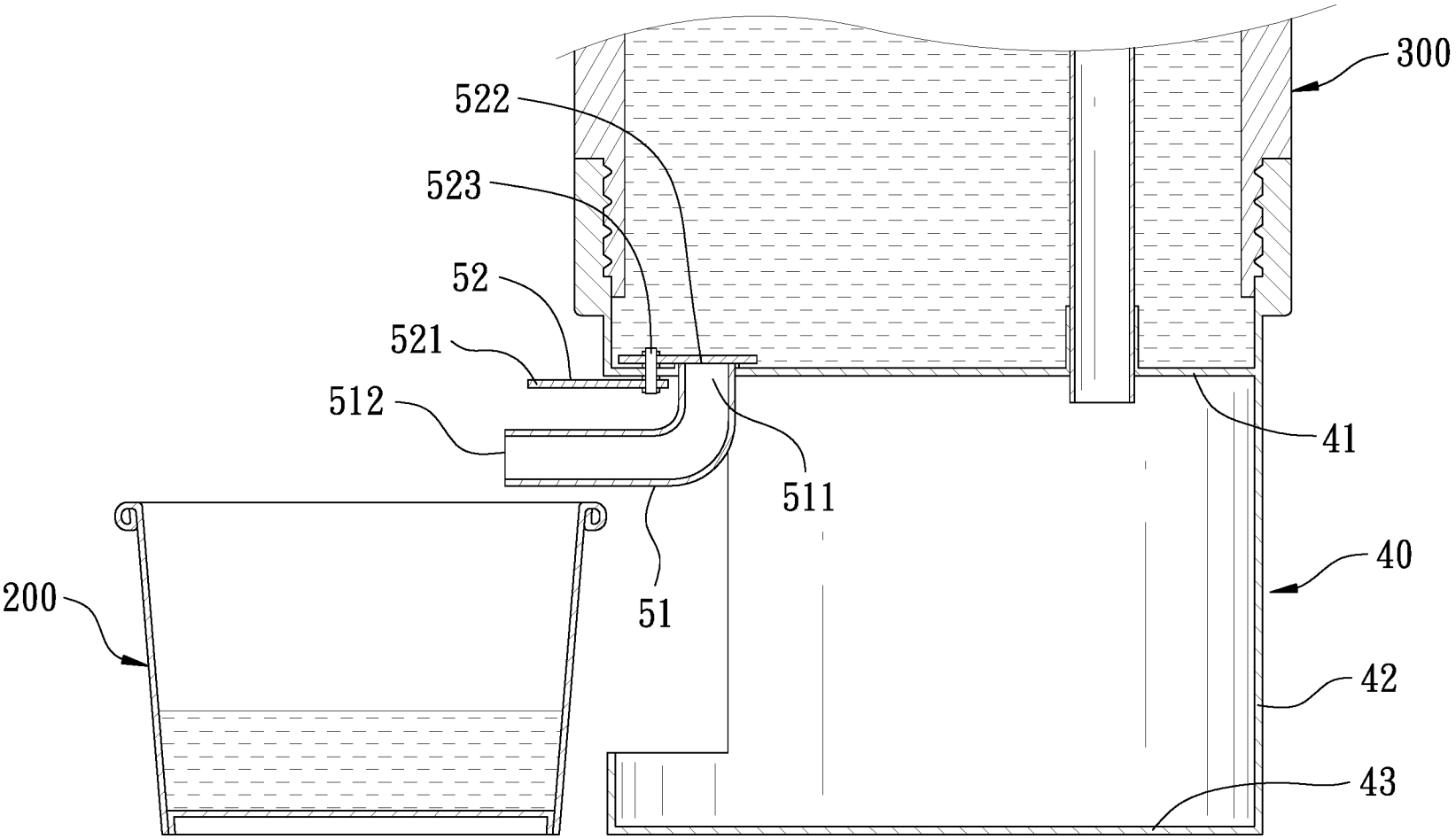
FIG. 8 is a schematic view of the operation of the second embodiment of the present invention, illustrating that the liquid contained in the bottle can be poured into a small cup via the guide tube when the bottle is in an inverted state.

FIGS. 6-8 illustrate a cup (bottle) with a cover structure according to a second embodiment of the present invention. The container for containing a liquid is a bottle 300. The inside of the bottle 300 is concavely formed with an accommodating space 301. The upper end of the bottle 300 is formed with an opening 302. The cover structure of this embodiment includes another cover body 40 and another liquid discharge mechanism 50. The cover body 40 has a first plane 41, a wall portion 42, and a second plane 43. The liquid discharge mechanism 50 includes a guide tube 51 and a switch 52. The second embodiment is substantially similar to the first embodiment with the exceptions described hereinafter. The guide tube 51 is a reverse L-shaped hollow tube. One end of the guide tube 51 is defined as an inlet end 511 insertedly connected to the first plane 41, and the other end of the guide tube 51 is defined as an outlet end 512 extending out of the wall portion 42. The switch 52 includes a push plate 521 extending out of the cover body 40, a block plate 522 extending to the inlet end 511 of the guide tube 51, and a pivot pin 523 that couples the push plate 521 and the block plate 522 to the first plane 41. The block plate 522 is linked with the push plate 521 through the pivot pin 523. When the push plate 521 is turned by the users finger, the block plate 522 can be actuated to close or open the inlet end 511 of the guide tube 51. In this way, the liquid in the bottle 300 is controlled to enter the guide tube 51 and flow to the outlet 512 of the guide tube 51 to be poured into the small cup 200 to facilitate drinking.

In summary, the cover structure of the cup (bottle) of the present invention is to solve the shortcomings, for example, the drink in the traditional cup (bottle) may spill or burn the user's mouth, and when a large cup (bottle) is filled with high-end drinks, users can only drink the drinks by taking big mouthfuls with his/her mouth to contact the opening of the large cup (bottle), not sipping the drinks. The main feature of the present invention is to change the cover structure of the cup (bottle). The cover structure of the present invention comprises a cover body 10 and a liquid discharge mechanism 20. The cover body 10 has a first plane 11, a wall portion 12 and a second plane 13. A small cup 200 is hidden inside the cover body 10. The liquid discharge mechanism 20 is disposed on the first plane 11 of the cover body 10, and includes a guide tube 21 and a switch 22. When the user wants to drink the liquid, the cup (bottle) is inverted, and the second plane 13 of the cover body 10 is placed on a tabletop so that the liquid contained in the cup (bottle) can enter the guide tube 21. After that, the user operates the switch 22 for controlling the guide tube 21 to discharge the liquid into the small cup 200 for drinking. Therefore, the present invention makes the cup (bottle) easy to storage and carry. When the user wants to drink the liquid, he/she can use the small cup 200 conveniently for drinking the liquid, thereby achieving safe, convenient and high-quality drinking effects.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A cover structure of a cup (bottle), an inside of the cup (bottle) being concavely formed with an accommodating space for containing a predetermined liquid, an upper end of the cup (bottle) being formed with an opening communicating with the accommodating space, the cover structure comprising:

a cover body, having a first plane for closing the opening of the cup (bottle), a wall portion extending upward from the first plane by a predetermined height, and a second plane extending horizontally from an upper edge of the wall portion and parallel to the first plane;

a liquid discharge mechanism, including a guide tube insertedly disposed on the first plane for guiding the liquid in the cup (bottle) and a switch disposed on the guide tube for controlling the liquid to be discharged, one end of the guide tube being defined as an inlet end extending into the accommodating space of the cup (bottle), another opposing end of the guide tube being defined as an outlet end extending out of the cover body and having a predetermined height from the second plane;

an inside of the cover body is concavely formed with an accommodating room;

one side of the wall portion is formed with an exit communicating with the accommodating room; and a small cup is provided in the accommodating room, and the small cup can be taken out via the exit.

2. The cover structure of the cup (bottle) as claimed in claim 1, wherein an outer periphery of the outlet end of the guide tube is formed with a hole, the switch is sleeved on the outlet end of the guide tube, an outer periphery of the switch is formed with an outlet, and the switch is rotatable to align the outlet with the hole of the guide tube.

3. The cover structure of the cup (bottle) as claimed in claim 2, wherein an outer periphery of the switch is provided with a handle portion.

4. The cover structure of the cup (bottle) as claimed in claim 1, further comprising a tube that is insertedly disposed below the first plane of the cover body, a lower end of the tube extending into the accommodating space of the cup (bottle).

5. The cover structure of the cup (bottle) as claimed in claim 1, wherein the switch includes a push plate extending out of the cover body, a block plate extending to the inlet end of the guide tube, and a pivot pin that couples the push plate and the block plate to the first plane.

* * * * *